US006014880A

United States Patent [19]

MacDonald et al.

[11] Patent Number: 6,014,880

[45] Date of Patent: Jan. 18, 2000

[54] STEEL SIDING MACHINE

[75] Inventors: Lorne MacDonald; Don Pockrandt, both of Regina, Canada

[73] Assignee: North American Machine Manufacturing Ltd., Saskatchewan, Canada

[21] Appl. No.: 09/116,637

[22] Filed: Jul. 16, 1998

[51] Int. Cl.[7] ..... B21D 5/08

[52] U.S. Cl. ..... 72/181

[58] Field of Search ..... 72/181, 421, 178, 72/176

[56] References Cited

U.S. PATENT DOCUMENTS

| | | | |
|---|---|---|---|
| 3,759,077 | 9/1973 | Hartkopf | 72/99 |
| 4,343,171 | 8/1982 | Kagawa | 72/181 |
| 4,787,233 | 11/1988 | Beymer . | |
| 5,038,592 | 8/1991 | Knudson . | |
| 5,319,952 | 6/1994 | Cadney . | |
| 5,394,722 | 3/1995 | Meyer . | |
| 5,425,259 | 6/1995 | Coben | 72/181 |
| 5,722,278 | 3/1998 | Horino et al. . | |
| 5,732,582 | 3/1998 | Knudson . | |
| 5,740,687 | 4/1998 | Meyer et al. . | |
| 5,787,748 | 8/1998 | Knudson | 72/181 |

*Primary Examiner*—Daniel C. Crane
*Attorney, Agent, or Firm*—Adams Law Firm, P.A.

[57] ABSTRACT

The invention provides a siding machine for making metal siding having a formed top edge, a formed bottom edge, and a formed middle portion, from a coil of sheet metal which feeds between upper and lower rolls. The machine comprises a flat board former section having a fixed position bottom edge former, a plurality of fixed position driven upper and lower drive roll sets for feeding the sheet metal through the machine and an adjustable top edge former. The top edge former is adjustable from a minimum width closest to the bottom edge former to a maximum width. A transformer section receives a flat formed board from the flat board former section for forming a decorative profile in the middle portion of the board. Transformer rolls are mounted on an adjustable frame adjustable, within pre-set limits, perpendicular to the direction of travel of the board such that the transformer rolls may contact and form the board at a chosen location on its face. An improved motor drive control is also provided that starts the machine gently, reducing jamming and electrical overload, and allows the operating speed to be varied.

19 Claims, 7 Drawing Sheets

STEEL SIDING MACHINE

This invention deals with the field of machines for roll-forming metal siding (siding machines) and in particular such a siding machine that is adjustable between two defined limits for various material widths and cross-sectional profiles.

BACKGROUND

Portable roll-forming machines are commonly used in construction for forming strips of metal into siding. In the past, such roll-formers have been able to make only one width of siding. Thus to change from 8 inch siding to 10 or 12 inch siding required a different machine to be brought in. Recently machines have been disclosed which are adjustable for forming different widths of siding from different widths of rolled metal strips.

One such machine is disclosed in U.S. Pat. No. 5,038,592 to Knudsen. The rolls are adjustable by sliding them on their shafts in order to accommodate various widths of material and to produce various sizes of siding.

Other roll-formers have been directed to formed metal products in general, such as roof panels, siding, structural members and eaves-troughs, with accommodation for varying widths of material and product. Examples of these are shown in the following patents:

U.S. Pat. No. 5,740,687 to Meyer

U.S. Pat. No. 5,732,582 to Knudsen

U.S. Pat. No. 5,722,728 to Horino et al.

U.S. Pat. No. 5,394,722 to Meyer

U.S. Pat. No. 5,319,952 to Cadney.

U.S. Pat. No. 5,038,592 to Knudsen

U.S. Pat. No. 4,787,233 to Beymer

The first part of a siding machine, the flat board former, turns the sheet metal strip into a board, which can be installed on a wall as siding in that form. The board has a formed U-channel on the bottom edge and on the top edge either a punched nailing strip or a flange to accept a clamp, along with a lip to accept the upward leg of the U-channel on the next board. The standard nominal widths for such boards are 8, 10 and 12 inches, however regardless of the width, the formed profile is the same on each edge.

For most applications where such machines are used it is necessary to further form the board with a decorative profile. Commonly the board is formed so that when applied it takes on the appearance of two boards rather than one. This done by forming a bend or lap in the middle of the board. This is called a "double 4" on 8 inch siding, "double 5" on 10 inch siding or "double 6" on 12 inch siding. Another popular profile is the "Dutch lap", which is a variation in the look of the double 4, etc. As well as decoration these profiles add strength to the siding.

This decorative forming is accomplished in the second part of the machine, commonly called the transformer, which acts only on the middle of the board, since the top and bottom sides are already finished when the board enters the transformer. Often the transformer has been an optional machine which is simply added on to the end of the flat board former if needed. In some machines, see for example U.S. Pat. No. 4,787,233 to Beymer, the whole transformer is changed in order to change the decorative profile or to accommodate different widths of siding.

In machines designed to accept varying widths of sheet metal strips, it has been a cumbersome and time-consuming task to change from material of one width to material of another, requiring careful adjustment of rollers and guides from one position to another. See for example U.S. Pat. No. 5,038,592 to Knudsen. A quickly and accurately adjustable machine would be desirable.

Present machines as well offer only limited and predetermined variations in width and decorative forming. For sale in areas where metric sizes are in use, a different machine must be built. Decorative designs are also very limited due to the expense of setting up for a different design, or the same design at a different location on the face of the board.

Another problem with existing siding machines is that they start with a jerk, which often causes the strip of sheet metal being fed into them to bind, resulting in a crash when the material ceases to feed. Such crashes result in wasted time and material as the sheet metal strip must be backed out of the machine and portions of bent material must often be cut off and discarded. Another result of such crashes is that breakers are often blown and must be reset. This is a particular problem as often the homeowner is away during the day when the work is being done, and the machine operator does not have access to re-set the breaker.

SUMMARY OF THE INVENTION

It is the object of the present invention to provide a roll-forming siding machine that is adjustable between a minimum and a maximum for different widths of sheet metal coils.

It is the further object of the present invention to provide such a roll-forming siding machine wherein the location of the decorative profile on the face of the board may be adjusted to any position on the face of the board between an upper limit and a lower limit.

It is the further object of the present invention to provide such a roll-forming siding machine wherein the decorative profile made by the rollers may be conveniently changed.

It is the further object of the present invention to provide such a roll-forming siding machine that starts gently, allowing the metal strip to start through the machine without binding.

The present invention accomplishes these objects providing a siding machine for making metal siding, said siding having a formed top edge, a formed bottom edge, and a formed middle portion, from a coil of sheet metal which feeds between upper and lower rolls, said machine comprising (1) a flat board former section supported in a framework and comprising a fixed position bottom edge former including a plurality of passive upper and lower forming rolls for forming said bottom edge; a plurality of fixed position driven upper and lower drive roll sets for feeding said sheet metal through the machine; and an adjustable top edge former, including a plurality of passive forming rolls for forming said top edge; wherein said top edge former is adjustable with respect to said bottom edge former from a minimum width closest to said bottom edge former to a maximum width farthest away from said bottom edge former; and (2) a transformer section for receiving a flat formed board from said flat board former section, said transformer section supported in said framework and comprising a fixed position driven upper and lower drive roll set for feeding said sheet metal through the machine; and a plurality of passive upper and lower transformer rolls, for forming a decorative profile in the middle portion of said board, mounted on an adjustable frame, said adjustable frame adjustable, within pre-set limits, perpendicular to the direction of travel of said board such that said transformer rolls may contact and form said board at a chosen location on the face of said board.

The flat board former and transformer are thus integral parts of the siding machine, allowing the machine to be compact and easily transported to the job site. The siding machine will accommodate any width of siding, whether standard, metric or some other width. The flat board former makes the same formed profile on the top and bottom edges of the board no matter what the width of the board. A shifting apparatus simply moves the adjustable top former relative to the fixed bottom former in order to accommodate any width of board.

The forming rolls for forming the top edge could be rotatably mounted on a carrier bar, and the carrier bar could be adjusted with respect to the bottom edge former by a plurality of threaded shafts acting between the carrier bar and the framework, wherein rotating the shafts moves the carrier bar. The threaded shafts could be coupled together so as to rotate in concert, thereby providing a more positive adjustment and keeping both ends of the carrier bar in the proper position.

The forming rolls are passive and rotate freely on their shafts. The sheet metal is fed through the machine by passing between the upper and lower rolls of separate driven drive roll sets. This method greatly simplifies the drive requirements of the machine, as well as the positioning of the forming rolls which is not so critical when they are not driven.

In the transformer section the edges are not further formed, and the board simply passes between the upper and lower drive rolls. The transformer rolls are again passive and mounted on an adjustable frame so that the rolls can be moved to any position on the face of the board allowing for versatility with respect to the decorative profile produced by the rolls. The board passes through this frame between the upper and lower transformer rolls.

The transformer section could comprise guide bars fixed to the framework perpendicular to the direction of travel of the board, the guide bars engaged by sleeves in the adjustable frame, and could further comprise means to controllably move the adjustable frame back and forth along the guide bars. The means to controllably move the adjustable frame could comprise a screw rotatably secured at one end to the framework or the adjustable frame and threadably engaged at the opposite end in the other of the framework or the adjustable frame, whereby turning the screw moves the framework along the guide bars. There could be two of these screws coupled together to provide a more positive adjustment.

The transformer rolls could be rotatably mounted on shafts, wherein the ends of the shafts are secured to the sides of the adjustable frame by bolts extending through holes in the sides of the adjustable frame and engaging in floating nuts in the ends of the shafts. The decorative profile and the location of the decorative profile on the board could be changed by removing the transformer rolls and shafts and replacing them with other transformer rolls and shafts. This method requires no adjustment of rolls on their shafts.

These holes could be L-shaped holes with one vertical and one horizontal leg, oriented such that the upper shaft may be secured in its operating position at a point along the vertical leg of an upper L-shaped hole, and such that the lower shaft is in its operating position at the end of a horizontal leg of a lower L-shaped hole, and such that when the bolts are loosened, the bolts and upper shafts may slide upward away from the operating position into the horizontal leg of said upper hole, and the bolts and lower shafts may slide horizontally away from the operating position and down into the vertical leg of the lower hole, where the bolts may be tightened, securing the shafts and transformer rolls in a non-operating position.

Changing the transformer shafts and rolls rather than adjusting rolls on the shafts simplifies the changeover from one profile to another, and is facilitated by the fact that the rolls are passive and so require no drive mechanism. The floating nuts in the ends of the shafts, more particularly described later in this disclosure, allow the shafts to be easily moved along the L-shaped holes to the non-operating position if it is desired to produce flat board. The floating nuts allow the shafts to be slightly shorter than the frame width while still being held securely to the frame. The shafts may also be removed from and replaced in the adjustable frame without binding.

Location of the shafts is critical to the proper operation of the machine and so stops could be provided at the ends of the holes where the shafts are in the operating position. The vertical legs of the upper L-shaped holes at each end of an upper transformer roll could each be in line with an elliptical stop such that when the bolts holding the shaft of the upper transformer roll are moved downward along the vertical legs into the operating position, the shaft will contact the elliptical stop at each end thereof thereby indicating the proper operating position for the transformer roll, and the elliptical stop could be rotated to adjust the operating position of the upper transformer roll to allow for varying thicknesses of sheet metal.

An electric power source could drive the drive roll sets and a control for the electric power source could operate such that the drive roll sets start turning slowly and gradually increase their rotational speed until the operating speed is attained. The control could also be operative to vary the operating speed.

This electric control greatly improves the operation of the machine, allowing the operator to ease the sheet metal into the rolls, as opposed to the current machines wherein there is a jerk as the machine immediately climbs to operating speed. The ability to vary the operating speed allows for greater productivity as the speed can be adjusted to operating conditions.

In another embodiment the invention provides a siding machine for making metal siding, said siding having a formed top edge and a formed bottom edge, from a coil of sheet metal said machine comprising a fixed position bottom edge former including a plurality of upper and lower passive forming rolls for forming said bottom edge; a plurality of fixed position upper and lower driven drive rolls for drawing said sheet metal through the machine; an adjustable top edge former, including a plurality of passive forming rolls for forming said top edge, that is adjustable from a minimum width closest to said bottom edge former to a maximum width farthest away from said bottom edge former; and an electric power source driving said drive rolls and controlled such that the drive rolls start slowly and gradually increase their rotational speed until the operating speed is attained; where in operation the sheet metal travels through said machine between said upper and lower rolls.

Where only a flat board is required, or where separate transformers are used, such a machine offers adjustment features and ease of operation.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
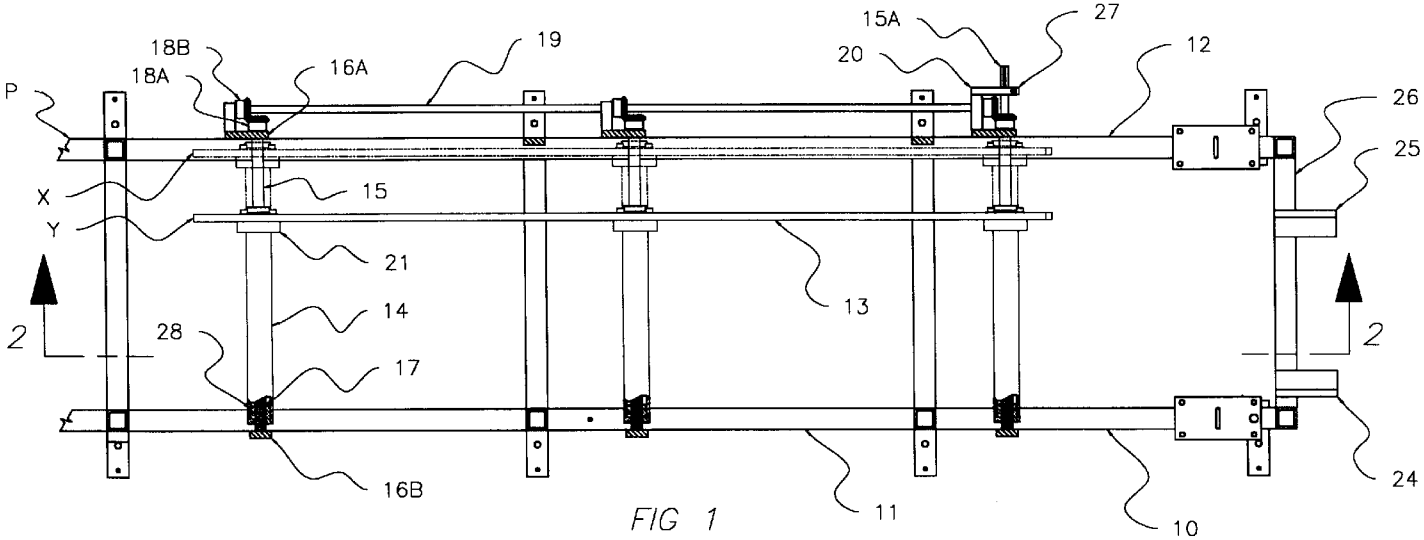
FIGS. 1 and 2 show cross-sectional top (Section "A—A") and side (Section "B—B") views of the flat board forming section of the preferred embodiment with the top and bottom edge forming rolls removed to allow the adjustable top edge former to be seen.
Figure 2:
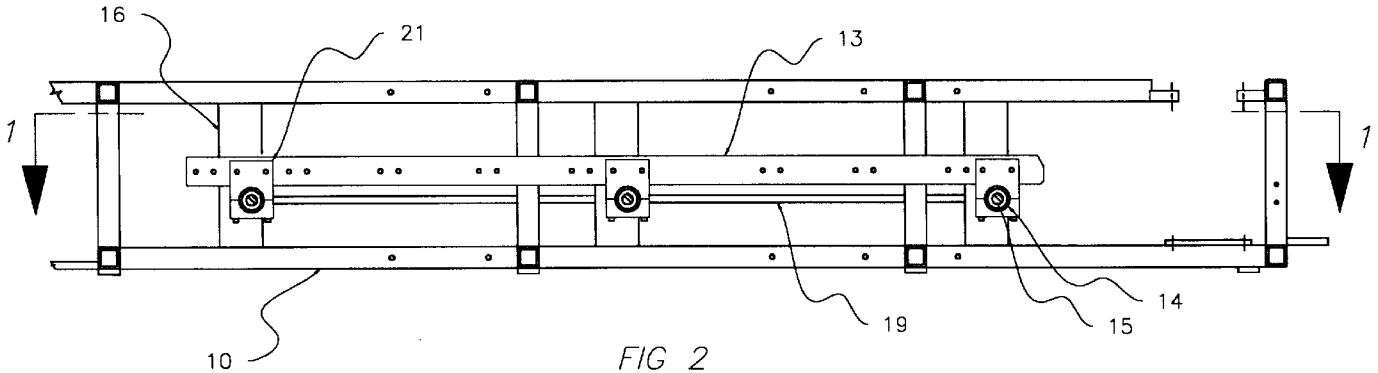

The preferred embodiment is illustrated in FIGS. 1–11. FIGS. 1 and 2 illustrate the construction of the flat board former section of the preferred embodiment. The direction of travel of the sheet metal from a coil is shown by arrow N. Bottom sheet guide 24 is fixed to framework 10 and top sheet guide 25 is adjustable along frame member 26 to accommodate the width of sheet metal being used. The bottom edge former comprises upper and lower forming rolls fixedly mounted on the bottom side 11 of the framework 10. The bottom edge former and drive roll sets are fixed as is well known in the art and are not shown.

The carrier bar 13 is parallel to the top side 12 and bottom side 11 of the framework 10, and mounted on three hollow carrier tubes 14 by tube clamps 21. Carrier shafts 15 are rotatably mounted at each end in upright carrier brackets 16 so as to rotate freely. The carrier shafts 15 have a threaded portion 17 adjacent to the bottom carrier brackets 16*b*. These threads are engaged in female threads 28 in the bottom end of the carrier tubes 14. A bushing in the top end keeps the shaft 15 centred in the carrier tube 14. Carrier shaft 15 extends through a bushing in top carrier bracket 16*a* and a bevel gear 18*a* is fixed to the end thereof. The bevelled gears 18*a* each engage a mating bevelled gear 18*b* mounted on adjusting shaft 19 rotatably mounted to the framework 10 perpendicular to the carrier shafts 15 and parallel to the top side 12 of the framework 10. One carrier shaft 15*a* extends beyond the bevelled gear 18*a* and through a bushing in a steady bracket 20. Turning this extended carrier shaft 15*a* causes the all three carrier shafts 15 to rotate in concert and so move the carrier bar 13 away from or closer to the bottom side 11 of the framework 10 where the bottom edge former is fixed, while maintaining the carrier bar in its proper aspect parallel to the sides of the framework 10. An electric drill is temporarily coupled to the extended carrier shaft 15*a* to rotate the mechanism. A shaft clamp 27 locks the mechanism when the proper position is reached. Two positions of the carrier bar 13 are illustrated in FIG. 1, a fully extended position X and a middle position Y.

The threaded shaft system described above is just one example of a mechanism for moving the carrier bar 13. Other means such as electric or hydraulic actuators or the like could be used to move the carrier bar and all such means are contemplated by the invention and considered to fall within its scope.

Figure 3:
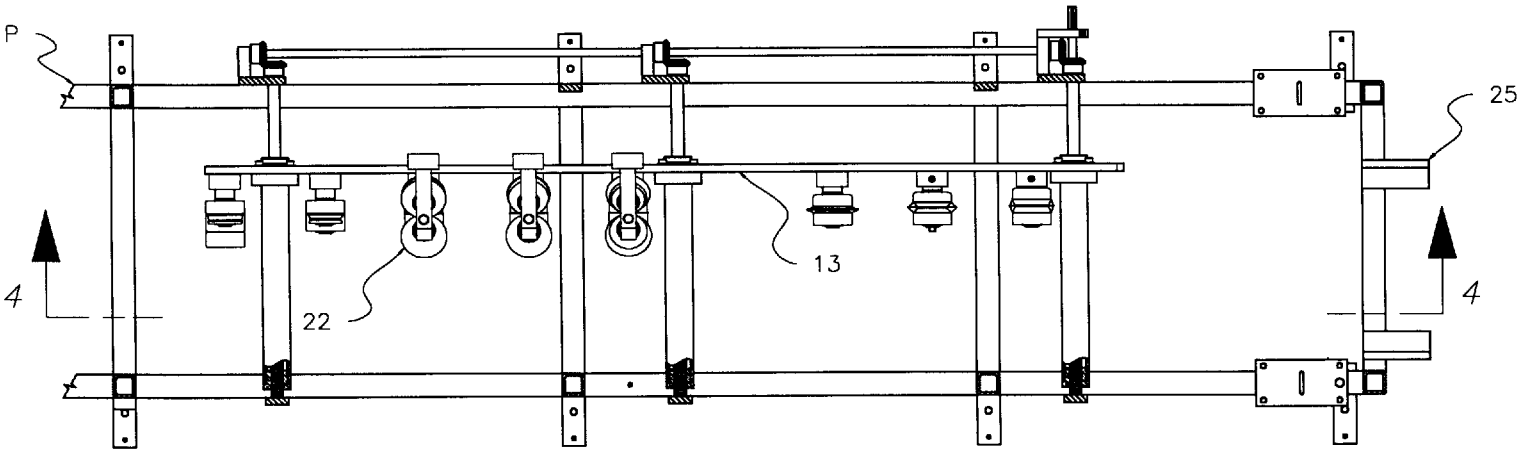
FIGS. 3 and 4 show cross-sectional top (Section "C—C") and side (Section "D—D") views of the flat board forming section of the preferred embodiment with the top edge forming rolls in place on the top edge former.
Figure 4:
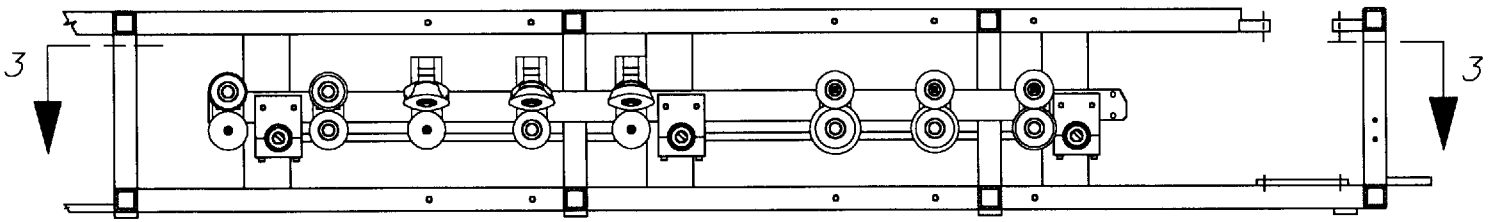

FIGS. 3 and 4 show the flat board former of FIG. 1 with top edge forming rolls 22 installed on the carrier bar 13. It can be seen that moving the carrier bar 13 and attached forming rolls 22 along with top sheet guide 25 will allow the operator to simply accommodate any width of sheet metal between maximum and minimum limits.

Figure 7:
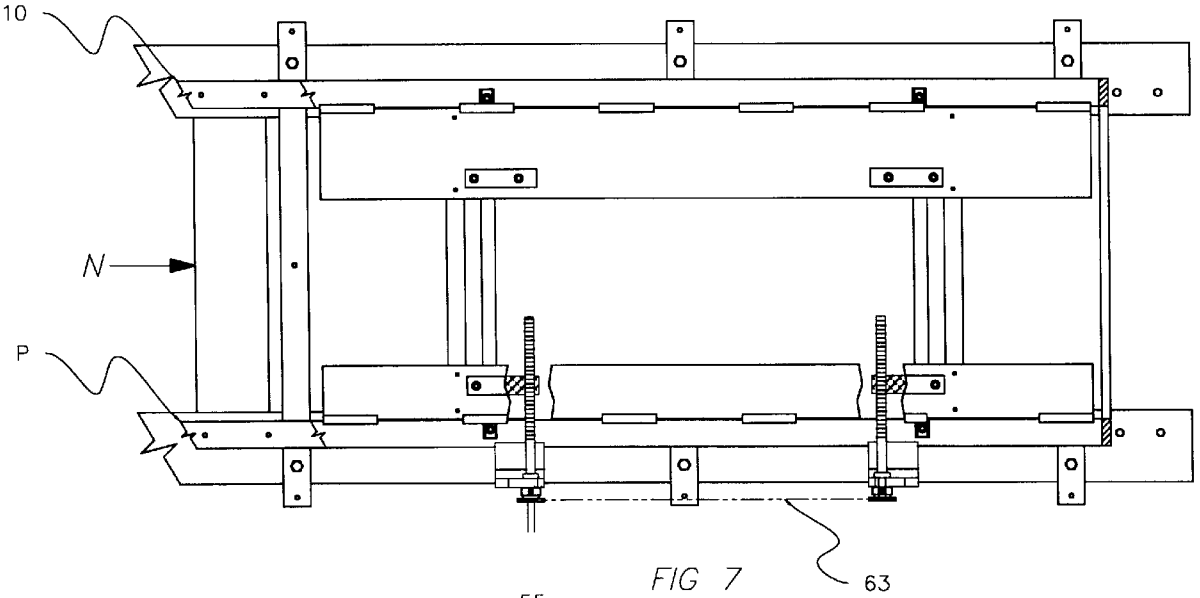
FIGS. 7 and 8 are a cut-away top view and a side view of the transformer section of the preferred embodiment with the transformer rolls and shafts removed.
Figure 8:
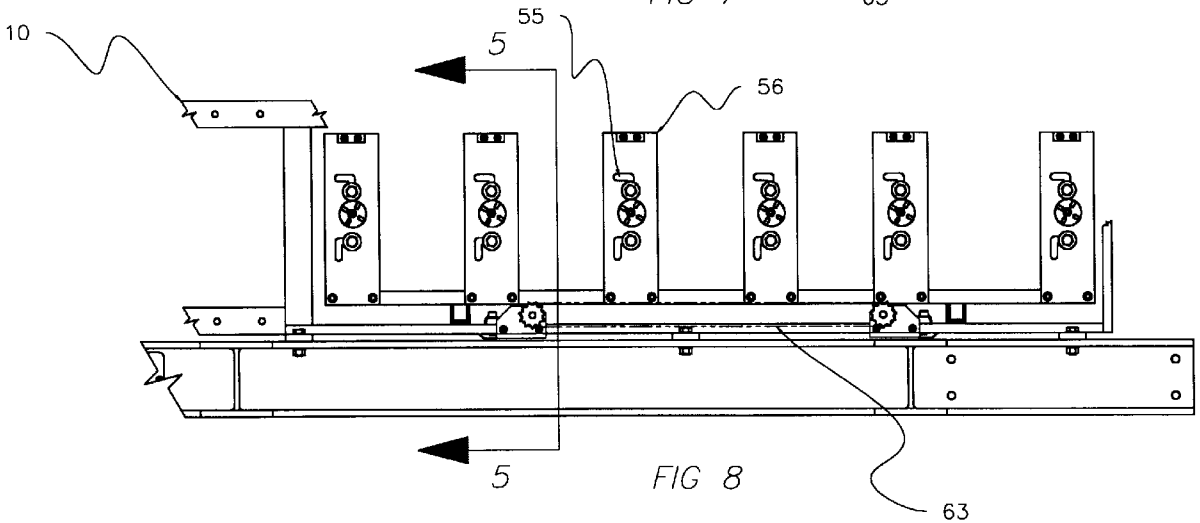

FIGS. 7 and 8 illustrate the construction of the transformer section of the preferred embodiment. The framework 10 of the siding machine is split at P to allow greater detail in the drawings. The framework 10 is a single long framework housing the flat board former section and the transformer section in line. The direction of travel of the sheet metal from the flat board former section is shown by arrow N. There are two driven fixed position upper and lower drive roll sets in the transformer section for feeding the sheet through the forming rolls. These are well known in the art and are not illustrated.

Figure 5:
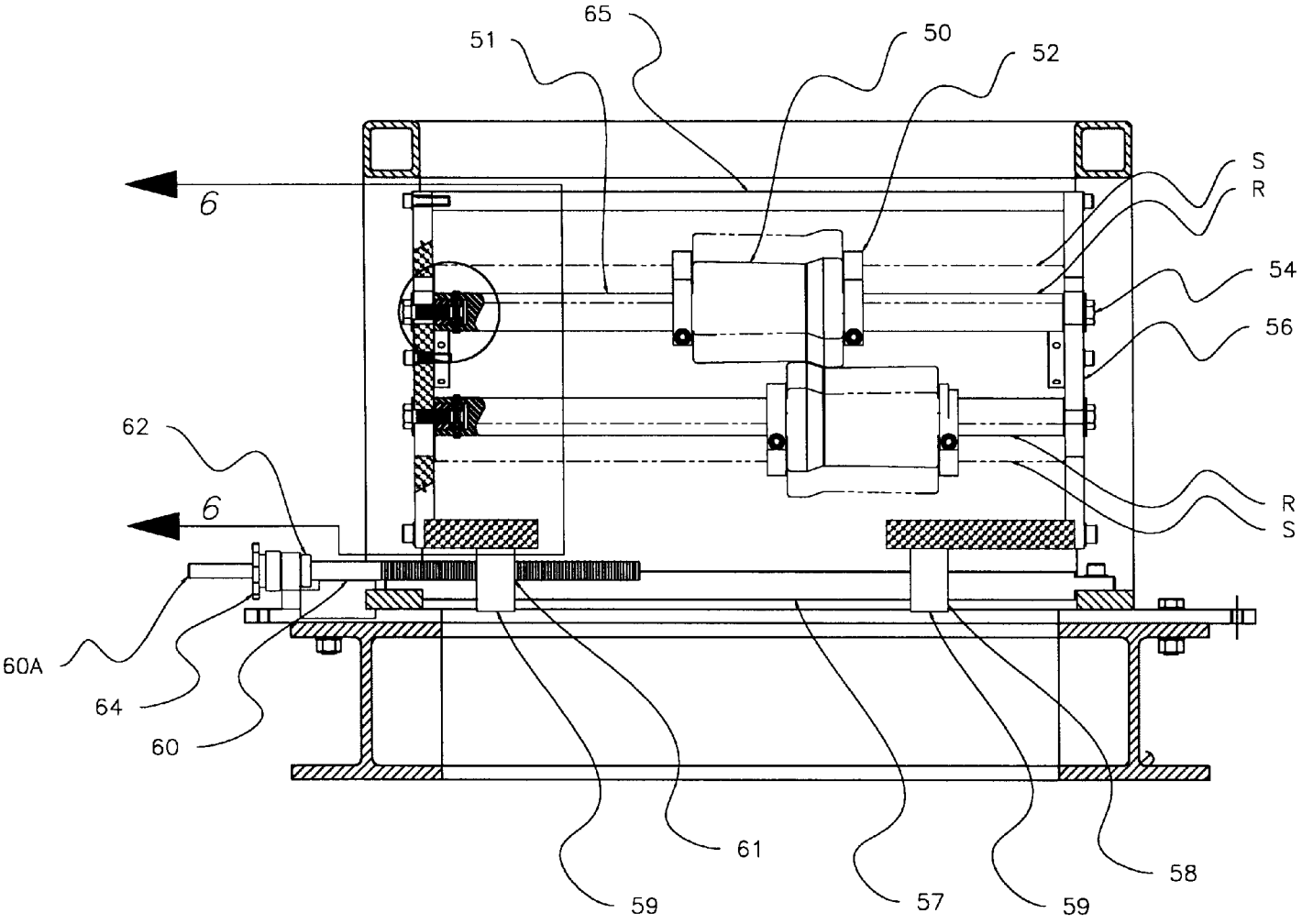
FIG. 5 is a cross-sectional (section "E—E") end (section "F—F") view of the transformer section of the preferred embodiment showing the transformer rolls and shafts in place.

As illustrated in FIG. 5, upper and lower transformer rolls 50 are rotatably mounted via bearings to transformer shafts 51 and held in place along the length of the transformer shafts 51 by collars 52. The transformer shafts 51 are fixedly attached to the adjustable frame 53 by bolts 54 through L-shaped holes 55 in upright frame brackets 56. The adjustable frame 53 moves perpendicular to the sheet travel direction N on guide bars 57 which are slidably engaged in sleeves 58 through blocks 59 fixed to the adjustable frame 53.

Control of the movement of the adjustable frame 53 is provided by two screws 60 engaged in threaded mating holes 61 in blocks 59. The screws 60 are rotatably mounted in bushings to the framework 10, and secured in position by screw collars 62. The two screws are coupled together by a roller chain 63 engaged on sprockets 64 fixed to the ends of the screws 60, such that the screws 60 rotate in concert and maintain the adjustable frame 53 in alignment. Extended screw 60*a* is temporarily engaged in an electric drill to turn the mechanism. Thus the transformer rolls 50 may be moved across the face of the flat board so as to provide a decorative profile at the desired location on the board, and so as to accommodate varying widths of board. The top and bottom edges of the board pass through the transformer section through the adjustable frame 53.

The screw system described above is just one example of a mechanism for moving the adjustable frame 53. Other means such as electric or hydraulic actuators or the like could be used to move the adjustable frame and all such means are contemplated by the invention and considered to fall within its scope.

FIG. 8 shows the six forming stations in the embodiment, as indicated by the six pairs of upright frame brackets 56. The adjustable frame top cross members 65 are removed in FIG. 7.

Figure 6:
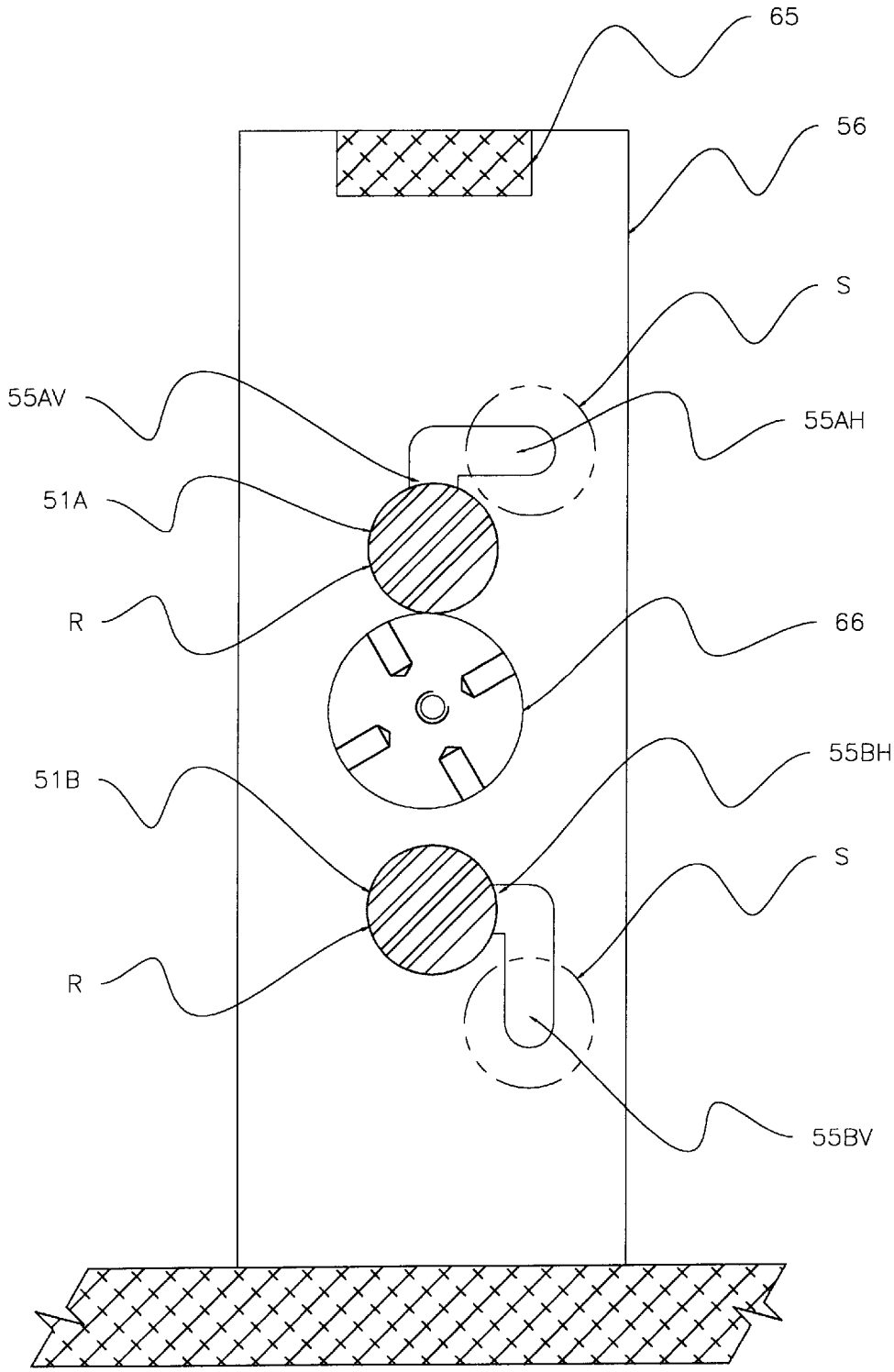
FIG. 6 is a cross-sectional view of the transformer shaft brackets showing the L-shaped holes and eccentric stop.

FIG. 6 shows a detail of the upright frame brackets 56 with the transformer shafts 51 in the operating position. Upper L-shaped hole 55*a* has its vertical leg 55*av* aligned with eccentric stop 66 such that the upper transformer shaft 51*a* rests on the stop 66 when in the operating position. Eccentric stop 66 may be rotated thereby adjusting the vertical operating position of the upper transformer shaft 51*a* to accommodate varying sheet thicknesses. Lower L-shaped hole 55*b* has its horizontal leg 55*bh* oriented such that the operating position of the lower transformer shaft 51*b* is at the end of the horizontal leg 55*bh*. To move the transformer shafts 51 out of the operating position to allow the flat board to move through the transformer without forming a decorative profile, bolts 54 are loosened and the upper transformer shaft 51*a* is moved up the vertical leg 55*av* and into the horizontal leg 55*ah*, and the lower transformer shaft 51*b* is moved along the horizontal leg 55*bh* and down into the vertical leg 55*bv*. The bolts 54 can then be tightened and the transformer shafts 51 and transformer rolls 50 are secured in the non-operating position. Alternatively the transformer shafts 51 may be removed and replaced with transformer shafts 51 carrying transformer rolls 50 for making a different decorative profile.

FIGS. 5 and 6 show the transformer rolls and shafts 50, 51 in the operating position R and the non-operating position S.

Figure 9:
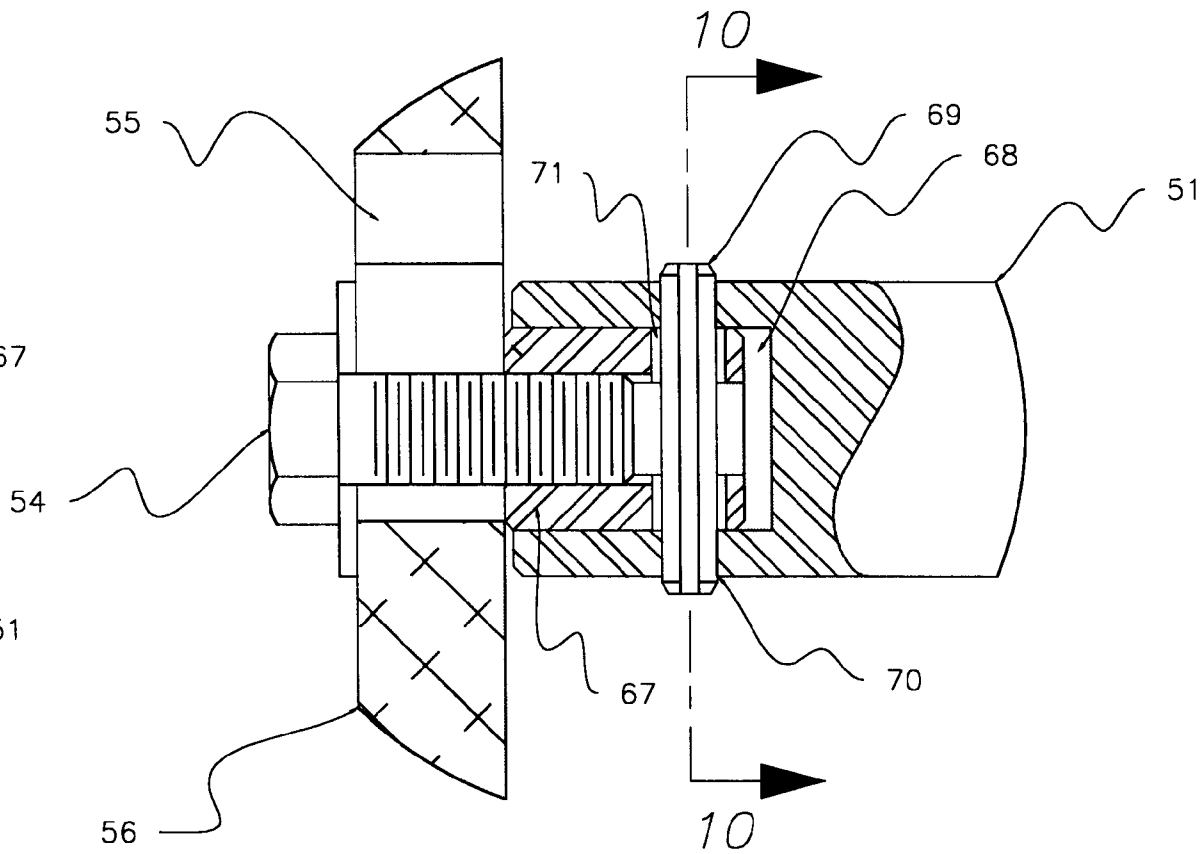
FIGS. 9 and 10 show cut-away and cross-section (section "Y—Y") detail views of the floating nut located in the end of the transformer shafts.
Figure 10:
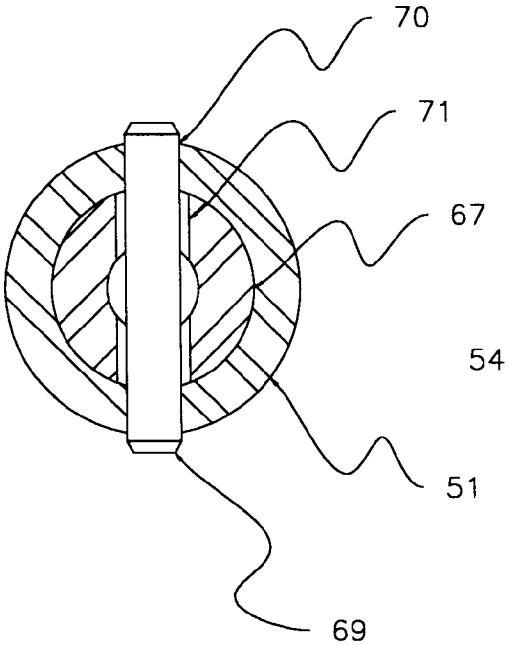

FIGS. 9 and 10 show a detail of the floating nuts 67 in the ends of the transformer shafts 51. These allow for easy movement of the transformer shafts 51 along the L-shaped holes 55 because the transformer shafts 51 are slightly shorter than the distance between the upright frame brackets 56. The floating nut 67 slides into a cavity 68 in the end of the transformer shaft 51. A roll pin 69 is inserted through shaft hole 70 and nut hole 71 near the bottom of the cavity 68 to secure the floating nut. Shaft hole 70 is sized such that the roll pin 69 fits tightly, thereby securing the pin 69 in the hole 70. Nut hole 71 has a larger diameter than the roll pin 69 allowing the nut 67 to "float" in the cavity 68. Bolt 54 is threaded into the floating nut 67 and is short enough that it does not contact the roll pin 69. When the bolt 54 is tightened, the floating nut 69 is drawn tight against the upright frame bracket 56 and the transformer shaft 51 is secured in position. The roll pin 69 prevents the transformer shaft 51 from rotating. When the bolt 54 is loosened, the floating nut 69 moves back into the cavity 68, away from the upright frame bracket 56, allowing the transformer shaft 51 to be easily moved between the upright frame brackets 56.

Figure 11:
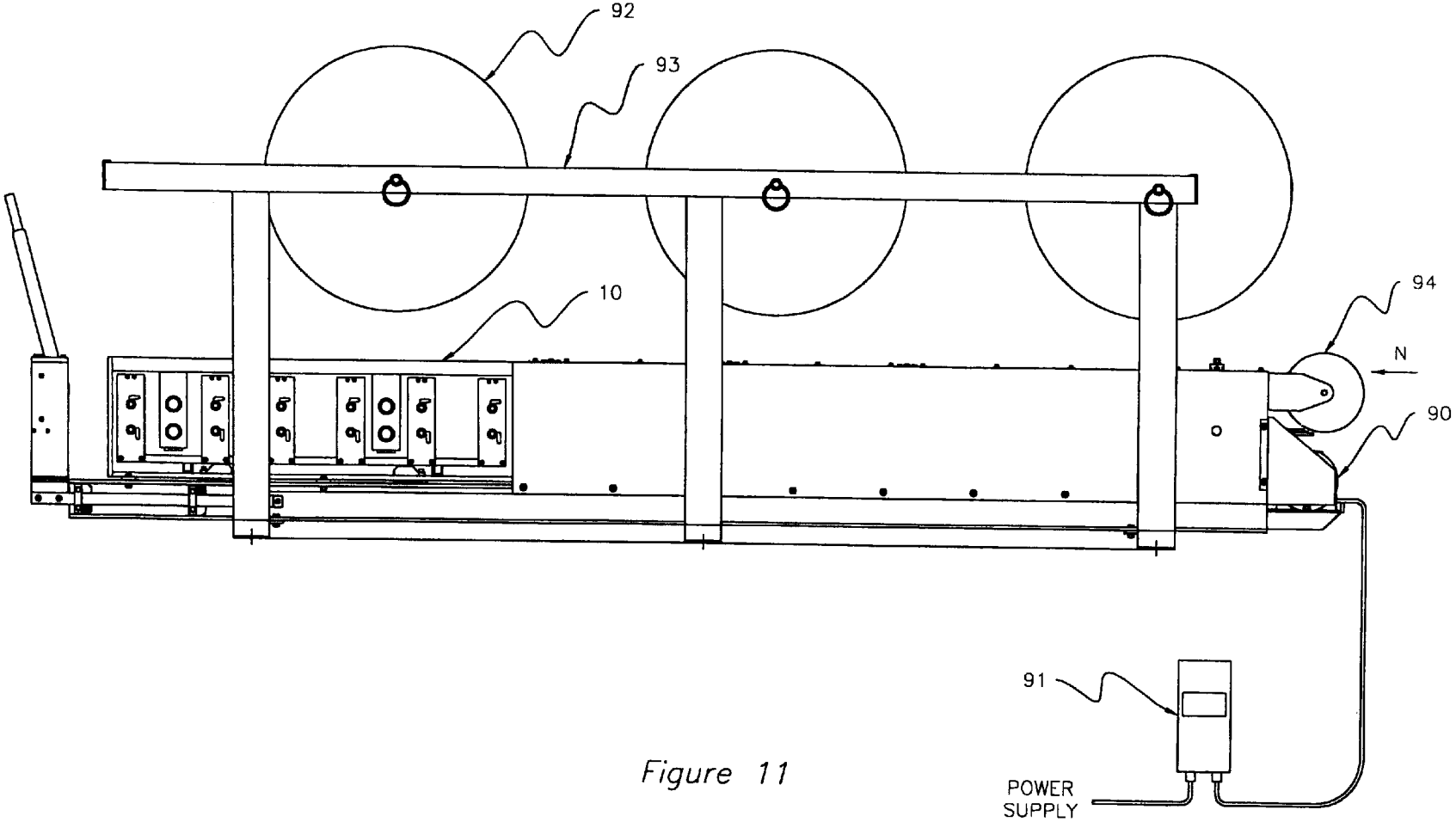
FIG. 11 shows the assembled siding machine.

FIG. 11 shows the siding machine set up ready for operation, with the flat board forming section and transformer section in line in the framework 10. The assembled machine is suitable for mounting on a trailer for easy hauling to the job-site. Sheet metal coils are mounted on spools 92 held in place on rack 93 from where the coil may conveniently be fed into the machine in direction N guided by guide roll 94.

A 115 volt drive motor 90 powers the drive roll sets. Drive motor 90 is controlled by a motor control 91 which starts the drive motor 91 and thus the drive rolls slowly, ramping up to the operating speed. The motor control 91 also allows the operating speed to be varied to suit the operating conditions encountered at the job site. The motor 90 and control 91 in the embodiment are from Reliance Electric, a subsidiary of Rockwell International. The motor 90 is three phase, one horsepower 1750 r.p.m., Reliance Model Number P56X1425R. The control 91 is a Reliance Model Number 1SU11001, which converts a single phase supply to a three phase supply for the motor 90, and provides the control features described above. Other motors and controls would serve the same purpose.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. A siding machine for making metal siding, said siding having a formed top edge, a formed bottom edge, and a formed middle portion, from a coil of sheet metal which feeds between upper and lower rolls, said machine comprising:

a flat board former section supported in a framework and comprising:

a fixed position bottom edge former including a plurality of passive upper and lower forming rolls for forming said bottom edge;

a plurality of fixed position driven upper and lower drive roll sets for feeding said sheet metal through the machine; and an adjustable top edge former, including a plurality of passive forming rolls for forming said top edge;

wherein said top edge former is adjustable with respect to said bottom edge former from a minimum width closest to said bottom edge former to a maximum width farthest away from said bottom edge former;

and a transformer section for receiving a flat formed board from said flat board former section, said transformer section supported in said framework and comprising:

a fixed position driven upper and lower drive roll set for feeding said sheet metal through the machine; and a plurality of passive upper and lower transformer rolls, for forming a decorative profile in the middle portion of said board, mounted on an adjustable frame, said adjustable frame adjustable, within pre-set limits, perpendicular to the direction of travel of said board such that said transformer rolls may contact and form said board at a chosen location on the face of said board.

2. The invention of claim 1 wherein said forming rolls for forming said top edge are rotatably mounted on a carrier bar, and wherein said carrier bar is adjusted with respect to said bottom edge former by a plurality of threaded shafts acting between said carrier bar and said framework wherein rotating said shafts moves the carrier bar.

3. The invention of claim 2 wherein said threaded shafts are coupled together so as to rotate in concert.

4. The invention of claim 1 wherein said transformer section comprises guide bars fixed to said framework perpendicular to the direction of travel of said board, said guide bars engaged by sleeves in said adjustable frame, and further comprises means to controllably move said adjustable frame back and forth along said guide bars.

5. The invention of claim 4 wherein said means to controllably move said adjustable frame back and forth along said guide bars comprises a screw rotatably secured at one end to said framework or said adjustable frame and threadably engaged at the opposite end in the other of said framework or said adjustable frame, whereby turning said screw moves said framework along said guide bars.

6. The invention of claim 5 comprising two of said screws coupled together so that they rotate in concert.

7. The invention of claim 1 wherein said plurality of passive upper and lower transformer rolls are rotatably mounted on shafts mounted on said adjustable frame, and wherein said decorative profile is changed by removing said transformer rolls and shafts and replacing them with other transformer rolls and shafts.

8. The invention of claim 1 comprising an electric power source driving said drive roll sets and a control for said electric power source operative such that said drive roll sets start turning slowly and gradually increase their rotational speed until the operating speed is attained.

9. The invention of claim 8 wherein said control is operative to vary said operating speed.

10. The invention of claim 1 wherein said transformer rolls are rotatably mounted on shafts, and wherein the ends of said shafts are secured to the sides of said adjustable frame by bolts extending through holes in said sides of said adjustable frame and engaging in floating nuts in the ends of said shafts.

11. The invention of claim 10 wherein said holes are L-shaped slots with one vertical and one horizontal leg, said slots being oriented such that the upper shaft may be secured in its operating position at a point along the vertical leg of an upper L-shaped slot, and such that the lower shaft is in its operating position at the end of a horizontal leg of a lower L-shaped slot, and such that when said bolts are loosened, said bolts and upper shafts may slide upward away from the operating position into the horizontal leg of said upper slot and said bolts and lower shafts may slide horizontally away from the operating position and down into the vertical leg of said lower slot, where said bolts may be tightened, securing said shafts and said transformer rolls in a non-operating position.

12. The invention of claim 11 wherein said decorative profile is changed by removing said transformer rolls and shafts and replacing them with other transformer rolls and shafts.

13. The invention of claim 11 wherein said vertical legs of said upper L-shaped slots at each end of an upper transformer roll are each in line with an elliptical stop such that when the bolts holding the shaft of said upper transformer roll are moved downward along said vertical legs into the operating position, the shaft will contact said elliptical stop at each end thereof thereby indicating the proper operating position for said transformer roll, and wherein said elliptical stop may be rotated to adjust the operating position of said upper transformer roll to allow for varying thicknesses of sheet metal.

14. The invention of claim 13 wherein said decorative profile is changed by removing said transformer rolls and shafts and replacing them with other transformer rolls and shafts.

15. The invention of claim 14 wherein said transformer section comprises guide bars fixed to said framework perpendicular to the direction of travel of said board, said guide bars engaged by sleeves in said adjustable frame, and further comprises means to controllably move said adjustable frame back and forth along said guide bars.

16. The invention of claim 15 wherein said means to controllably move said adjustable frame back and forth along said guide bars comprises a screw rotatably secured at one end to said framework or said adjustable frame and threadably engaged at the opposite end in the other of said framework or said adjustable frame, whereby turning said screw moves said framework along said guide bars.

17. The invention of claim 16 comprising two of said screws coupled so that they rotate in concert.

18. The invention of claim 17 comprising an electric power source driving said drive roll sets and a control for said electric power source operative such that said drive roll sets start turning slowly and gradually increase their rotational speed until the operating speed is attained.

19. The invention of claim 18 wherein said control is operative to vary said operating speed.

* * * * *